US007358912B1

(12) United States Patent
Kish et al.

(10) Patent No.: US 7,358,912 B1
(45) Date of Patent: Apr. 15, 2008

(54) COVERAGE ANTENNA APPARATUS WITH SELECTABLE HORIZONTAL AND VERTICAL POLARIZATION ELEMENTS

(75) Inventors: William Kish, Saratoga, CA (US); Victor Shtrom, Sunnyvale, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 0 days.

(21) Appl. No.: 11/413,461

(22) Filed: Apr. 28, 2006

Related U.S. Application Data

(60) Provisional application No. 60/694,101, filed on Jun. 24, 2005.

(51) Int. Cl.
*H01Q 21/00* (2006.01)

(52) U.S. Cl. ..... 343/725; 343/727

(58) Field of Classification Search ..... 343/725, 343/727, 700 MS, 767
See application file for complete search history.

(56) References Cited

U.S. PATENT DOCUMENTS

| | | | |
|---|---|---|---|
| 4,176,356 | A | 11/1979 | Foster et al. |
| 4,193,077 | A | 3/1980 | Greenberg et al. |
| 4,305,052 | A | 12/1981 | Baril et al. |
| 4,814,777 | A | 3/1989 | Monser |
| 5,173,711 | A | 12/1992 | Takeuchi et al. |
| 5,220,340 | A | 6/1993 | Shafai |
| 5,559,800 | A | 9/1996 | Mousseau et al. |
| 5,754,145 | A | 5/1998 | Evans |
| 5,767,809 | A | 6/1998 | Chuang et al. |
| 5,802,312 | A | 9/1998 | Lazaridis et al. |
| 5,964,830 | A | 10/1999 | Durrett |
| 6,034,638 | A | 3/2000 | Thiel et al. |
| 6,094,177 | A | 7/2000 | Yamamoto |
| 6,266,528 | B1 | 7/2001 | Farzaneh |
| 6,292,153 | B1 | 9/2001 | Aiello et al. |
| 6,307,524 | B1 | 10/2001 | Britain |
| 6,317,599 | B1 | 11/2001 | Rappaport et al. |
| 6,326,922 | B1 | 12/2001 | Hegendoerfer |
| 6,326,924 | B1 * | 12/2001 | Muramoto et al. ..... 343/702 |
| 6,337,628 | B2 | 1/2002 | Campana, Jr. |
| 6,337,668 | B1 | 1/2002 | Ito et al. |
| 6,339,404 | B1 | 1/2002 | Johnson et al. |

(Continued)

FOREIGN PATENT DOCUMENTS

| | | |
|---|---|---|
| EP | 0 534 612 | 3/1993 |

(Continued)

OTHER PUBLICATIONS

Ken Tang, et al., "MAC Layer Broadcast Support in 802.11 Wireless Networks," Computer Science Department, University of California, Los Angeles, 2000 IEEE, pp. 544-548.

(Continued)

*Primary Examiner*—Hoang V Nguyen
(74) *Attorney, Agent, or Firm*—Carr & Ferrell LLP

(57) ABSTRACT

An antenna apparatus comprises selectable antenna elements including a plurality of dipoles and/or a plurality of slot antennas ("slot"). Each dipole and/or each slot provides gain with respect to isotropic. The dipoles may generate vertically polarized radiation and the slots may generate horizontally polarized radiation. Each antenna element may have one or more loading structures configured to decrease the footprint (i.e., the physical dimension) of the antenna element and minimize the size of the antenna apparatus.

17 Claims, 7 Drawing Sheets

U.S. PATENT DOCUMENTS 6,345,043 B1 2/2002 Hsu
6,356,242 B1 3/2002 Ploussios
6,356,243 B1 3/2002 Schneider et al.
6,356,905 B1 3/2002 Gershman et al.
6,377,227 B1 4/2002 Zhu et al.
6,392,610 B1 5/2002 Braun et al.
6,400,329 B1 * 6/2002 Barnes ..... 343/787
6,404,386 B1 6/2002 Proctor, Jr. et al.
6,407,719 B1 6/2002 Ohira et al.
6,442,507 B1 8/2002 Skidmore et al.
6,445,688 B1 9/2002 Garces et al.
6,493,679 B1 12/2002 Rappaport et al.
6,498,589 B1 12/2002 Horii
6,499,006 B1 12/2002 Rappaport et al.
6,507,321 B2 1/2003 Oberschmidt et al.
6,625,454 B1 9/2003 Rappaport et al.
6,674,459 B2 1/2004 Ben-Shachar et al.
6,700,546 B2 * 3/2004 Benhammou et al. ..... 343/728
6,701,522 B1 3/2004 Rubin et al.
6,725,281 B1 4/2004 Zintel et al.
6,753,814 B2 6/2004 Killen et al.
6,762,723 B2 7/2004 Nallo et al.
6,779,004 B1 8/2004 Zintel
6,819,287 B2 11/2004 Sullivan et al.
6,876,280 B2 4/2005 Nakano
6,879,293 B2 * 4/2005 Sato ..... 343/702
6,888,504 B2 5/2005 Chiang et al.
6,888,893 B2 5/2005 Li et al.
6,892,230 B1 5/2005 Gu et al.
6,906,678 B2 6/2005 Chen
6,910,068 B2 6/2005 Zintel et al.
6,924,768 B2 8/2005 Wu et al.
6,931,429 B2 8/2005 Gouge et al.
6,941,143 B2 9/2005 Mathur
6,950,019 B2 9/2005 Bellone et al.
6,961,028 B2 11/2005 Joy et al.
6,973,622 B1 12/2005 Rappaport et al.
6,975,834 B1 12/2005 Forster
7,034,770 B2 4/2006 Yang et al.
7,043,277 B1 5/2006 Pfister
7,050,809 B2 5/2006 Lim
7,064,717 B2 6/2006 Kaluzni et al.
7,085,814 B1 8/2006 Ghandi et al.
7,089,307 B2 8/2006 Zintel et al.
7,130,895 B2 10/2006 Zintel et al.
7,171,475 B2 1/2007 Weisman et al.
2002/0031130 A1 3/2002 Tsuchiya et al.
2002/0047800 A1 4/2002 Proctor, Jr. et al.
2002/0080767 A1 6/2002 Lee
2002/0084942 A1 7/2002 Tsai et al.
2002/0105471 A1 8/2002 Kojima et al.
2002/0112058 A1 8/2002 Weisman et al.
2002/0158798 A1 10/2002 Chiang et al.
2002/0170064 A1 11/2002 Monroe et al.
2003/0026240 A1 2/2003 Eyuboglu et al.
2003/0030588 A1 2/2003 Kalis et al.
2003/0063591 A1 4/2003 Leung et al.
2003/0122714 A1 7/2003 Wannagot et al.
2003/0169330 A1 9/2003 Ben-Shachar et al.
2003/0184490 A1 10/2003 Raiman et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0227414 A1 12/2003 Saliga et al.
2004/0014432 A1 1/2004 Boyle
2004/0017310 A1 1/2004 Runkle et al.
2004/0017860 A1 1/2004 Liu
2004/0027291 A1 2/2004 Zhang et al.
2004/0027304 A1 2/2004 Chiang et al.
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0080455 A1 4/2004 Lee
2004/0095278 A1 5/2004 Kanemoto et al.
2004/0114535 A1 6/2004 Hoffmann et al.
2004/0125777 A1 7/2004 Doylye et al.
2004/0190477 A1 9/2004 Olson et al.
2004/0260800 A1 12/2004 Gu et al.
2005/0022210 A1 1/2005 Zintel et al.
2005/0041739 A1 2/2005 Li et al.
2005/0042988 A1 2/2005 Hoek et al.
2005/0074108 A1 4/2005 Zintel et al.
2005/0097503 A1 5/2005 Zintel et al.
2005/0135480 A1 6/2005 Li et al.
2005/0138137 A1 6/2005 Encamacion et al.
2005/0138193 A1 6/2005 Encamacion et al.
2005/0180381 A1 8/2005 Retzer et al.
2005/0188193 A1 8/2005 Kuehnel et al.
2005/0240665 A1 10/2005 Gu et al.
2005/0267935 A1 12/2005 Ghandi et al.
2006/0094371 A1 5/2006 Nguyen
2006/0098607 A1 5/2006 Zeng et al.
2006/0123124 A1 6/2006 Weisman et al.
2006/0123125 A1 6/2006 Weisman et al.
2006/0123455 A1 6/2006 Pai et al.
2006/0168159 A1 7/2006 Weisman et al.
2006/0184661 A1 8/2006 Weisman et al.
2006/0184693 A1 8/2006 Rao et al.
2006/0187660 A1 8/2006 Rao et al.
2006/0224690 A1 10/2006 Falkenburg et al.
2006/0225107 A1 10/2006 Seetharaman et al.
2006/0227761 A1 10/2006 Scott, III et al.
2006/0239369 A1 10/2006 Lee
2006/0291434 A1 12/2006 Gu et al.
2007/0027622 A1 2/2007 Cleron et al.
2007/0135167 A1 6/2007 Liu

FOREIGN PATENT DOCUMENTS

EP 1 315 311 5/2003
EP 1 450 521 8/2004
EP 1 608 108 12/2005
JP 2008/088633 2/1996
JP 2001/057560 2/2002
JP 2005/354249 12/2005
JP 2006/060408 3/2006
WO WO 02/25967 3/2002
WO WO 03/079484 9/2003

OTHER PUBLICATIONS

Ken Tang, et al., "MAC Reliable Broadcast in Ad Hoc Networks," Computer Science Department, Unviversity of California, Los Angeles, 2001 IEEE, pp. 1008-1013.
Vincent D. Park, et al., "A Performance Comparison of the Temporally-Ordered Routing Algorithm and Ideal Link-Skate Routing," IEEE, Jul. 1998, pp. 592-598.
Ian, F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology, no date avail.
Dell Inc., "How Much Broadcast and Multicast Traffic Should I Allow in My Network," PowerConnect Application Note #5, Nov. 2003.
Toskala, Antti, "Enhancement of Broadcast and Introduction of Multicast Capabilities in RAN," Nokia Networks, Palm Springs, California, Mar. 13-16, 2001.
Microsoft Corporation, "IEEE 802.11 Networks and Windows XP," Windows Hardware Developer Central, Dec. 4, 2001.

Festag, Andreas, "What is MOMBASA?" Telecommunication Networks Group (TKN), Technical University of Berlin, Mar. 7, 2002.
Hewlett Packard, "HP ProCurve Networking: Enterprise Wireless LAN Networking and Mobility Solutions," 2003.
Dutta, Ashutosh et al., "MarconiNet Supporting Streaming Media Over Localized Wireless Multicast," Proc. of the 2d Int'l Workshop on Mobile Commerce, 2002.
Dunkels, Adam et al., "Making TCP/IP Viable for Wireless Sensor Networks," Proc. of the 1st Euro. Workshop on Wireless Sensor Networks, Berlin, Jan. 2004.
Dunkels, Adam et al., "Connecting Wireless Sensornets with TCP/IP Networks," Proc. of the 2d Int'l Conf. on Wired Networks, Frankfurt, Feb. 2004.
Cisco Systems, "Cisco Aironet Access Point Software Configuration Guide: Configuring Filters and Quality of Service," Aug. 2003.
Hirayama, Koji et al., "Next-Generation Mobile-Access IP Network," Hitachi Review vol. 49, No. 4, 2000.
Pat Calhoun et al., "802.11r strengthens wireless voice," Technology Update, Network World, Aug. 22, 2005, http://www.networkworld.com/news/tech/2005/082208techupdate.html.
Areg Alimian et al., "Analysis of Roaming Techniques," doc.:IEEE 802.11-04/0377r1, Submission, Mar. 2004.
Information Society Technologies Ultrawaves, "System Concept / Architecture Design and Communication Stack Requirement Document," Feb. 23, 2004.
Golmie, Nada, "Coexistence in Wireless Networks: Challenges and System-Level Solutions in the Unlicensed Bands," Cambridge University Press, 2006.
Mawa, Rakesh, "Power Control in 3G Systems," Hughes Systique Corporation, Jun. 28, 2006.
Wennstrom, Mattias et al., "Transmit Antenna Diversity in Ricean Fading MIMO Channels with Co-Channel Interference," 2001.
Steger, Christopher et al., "Performance of IEEE 802.11b Wireless LAN in an Emulated Mobile Channel," 2003.
Chang, Nicholas B. et al., "Optimal Channel Probing and Transmission Scheduling for Opportunistics Spectrum Access," Sep. 2007.

* cited by examiner

COVERAGE ANTENNA APPARATUS WITH SELECTABLE HORIZONTAL AND VERTICAL POLARIZATION ELEMENTS

CROSS-REFERENCE TO RELATED APPLICATIONS

This application claims the priority benefit of U.S. provisional patent application No. 60/694,101 filed Jun. 24, 2005, the disclosure of which is incorporated herein by reference. This application is related to and incorporates by reference co-pending U.S. application Ser. No. 11/041,145 titled "System and Method for a Minimized Antenna Apparatus with Selectable Elements" filed Jan. 21, 2005; U.S. application Ser. No. 11/022,080 titled "Circuit Board having a Peripheral Antenna Apparatus with Selectable Antenna Elements" filed Dec. 23, 2004; U.S. application Ser. No. 11/010,076 titled "System and Method for Omnidirectional Planar Antenna Apparatus with Selectable Elements" filed Dec. 9, 2004; U.S. application Ser. No. 11/180,329 titled "System and Method for Transmission Parameter Control for an Antenna Apparatus with Selectable Elements" filed Jul. 12, 2005; and U.S. application Ser. No. 11/190,288 titled "Wireless System Having Multiple Antenna and Multiple Radios" filed Jul. 26, 2005.

BACKGROUND OF INVENTION

1. Field of the Invention

The present invention relates generally to wireless communications, and more particularly to an antenna apparatus with selectable horizontal and vertical polarization elements.

2. Description of the Prior Art

In communications systems, there is an ever-increasing demand for higher data throughput and a corresponding drive to reduce interference that can disrupt data communications. For example, in an IEEE 802.11 network, an access point (i.e., base station) communicates data with one or more remote receiving nodes or stations, e.g., a network interface card of a laptop computer, over a wireless link. The wireless link may be susceptible to interference from other access points and stations, other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One method for reducing interference in the wireless link between the access point and the remote receiving node is to provide several omnidirectional antennas, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link.

However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space. Typical horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point. Yet another problem is that the access point with the typical omnidirectional antennas is a relatively large physically, because the omnidirectional antennas extend from the housing.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another method to reduce interference involves beam steering with an electronically controlled phased array antenna. However, the phased array antenna can be extremely expensive to manufacture. Further, the phased array antenna can require many phase tuning elements that may drift or otherwise become maladjusted.

SUMMARY OF THE INVENTION

In one aspect, a system comprises a communication device configured to generate or receive a radio frequency (RF) signal, an antenna apparatus configured to radiate or receive the RF signal, and an antenna element selector. The antenna apparatus includes a first planar element configured to radiate or receive the RF signal in a horizontal polarization and a second planar element configured to radiate or receive the RF signal in a vertical polarization. The antenna element selector is configured to couple the RF signal to the first planar element or the second planar element.

In some embodiments, the antenna apparatus is configured to radiate or receive the RF signal in a diagonal polarization if the first planar element and the second planar element are coupled to the RF signal. The antenna apparatus may be configured to radiate or receive the RF signal in a substantially omnidirectional radiation pattern. The first planar element may comprise a slot antenna and the second planar element may comprise a dipole. The antenna element selector may comprise a PIN diode network configured to couple the RF signal to the first planar element or the second planar element.

In one aspect, an antenna apparatus comprises a first substrate including a first planar element and a second planar element. The first planar element is configured to radiate or receive a radio frequency (RF) signal in a horizontal polarization. The second planar element is configured to radiate or receive the RF signal in a vertical polarization.

In some embodiments, the first planar element and the second planar element comprise a circuit board. The antenna apparatus may comprise a second substrate including a third planar element coupled substantially perpendicularly to the circuit board. The second substrate may be coupled to the circuit board by solder.

In one aspect, a method of manufacturing an antenna apparatus comprises forming a first antenna element and a second antenna element from a printed circuit board substrate, partitioning the printed circuit board substrate into a first portion including the first antenna element and a second portion including the second antenna element and coupling the first portion to the second portion to form a non-planar antenna apparatus. Coupling the first portion to the second portion may comprise soldering the first portion to the second portion.

In one aspect, a system comprises a housing, a communication device, and an antenna apparatus including one or more slot antennas integral with the housing. One or more of the slot antennas may comprise loading elements configured to decrease a footprint of the slot antenna. One or more of the slot antennas may comprise an aperture formed in the housing.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

Figure 1:
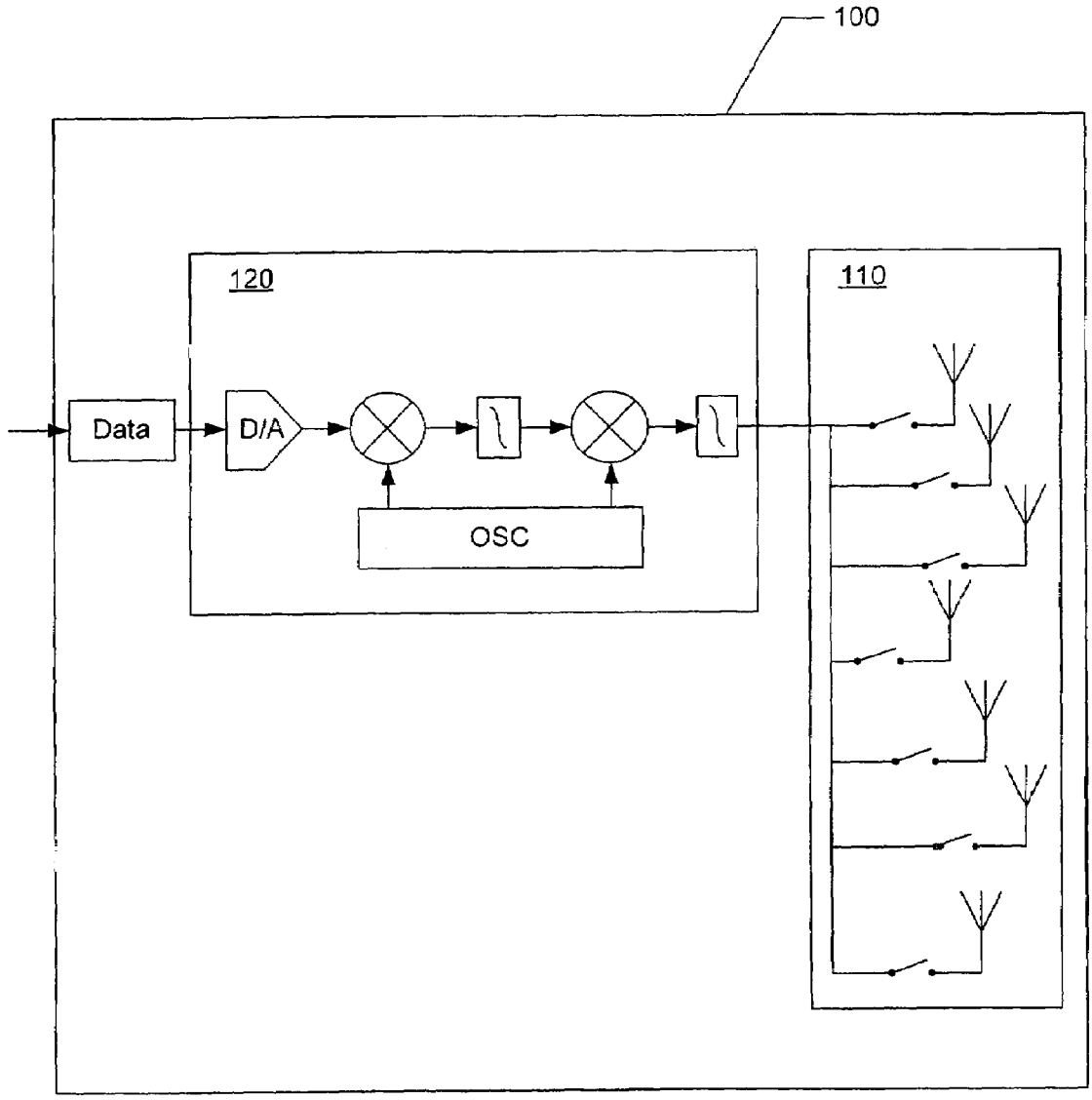
FIG. 1 illustrates a system comprising an antenna apparatus with selectable horizontal and vertical polarization elements, in one embodiment in accordance with the present invention.

A system for a wireless (i.e., radio frequency or RF) link to a remote receiving node includes a communication device for generating an RF signal and an antenna apparatus for transmitting and/or receiving the RF signal. The antenna apparatus comprises a plurality of modified dipoles (also referred to herein as simply "dipoles") and/or a plurality of modified slot antennas (also referred to herein as simply "slots"). In a preferred embodiment, the antenna apparatus includes a number of slots configured to transmit and/or receive horizontal polarization, and a number of dipoles to provide vertical polarization. Each dipole and each slot provides gain (with respect to isotropic) and a polarized directional radiation pattern. The slots and the dipoles may be arranged with respect to each other to provide offset radiation patterns.

In some embodiments, the dipoles and the slots comprise individually selectable antenna elements and each antenna element may be electrically selected (e.g., switched on or off) so that the antenna apparatus may form a configurable radiation pattern. An antenna element selector is included with or coupled to the antenna apparatus so that one or more of the individual antenna elements may be selected or active. If certain or all elements are switched on, the antenna apparatus forms an omnidirectional radiation pattern, with both vertically polarized and horizontally polarized (also referred to herein as diagonally polarized) radiation. For example, if two or more of the dipoles are switched on, the antenna apparatus may form a substantially omnidirectional radiation pattern with vertical polarization. Similarly, if two or more of the slots are switched on, the antenna apparatus may form a substantially omnidirectional radiation pattern with horizontal polarization.

The antenna apparatus is easily manufactured from common planar substrates such as FR4 printed circuit board (PCB). The PCB may be partitioned into portions including one or more elements of the antenna apparatus, which portions may then be arranged and coupled (e.g., by soldering) to form a non-planar antenna apparatus having a number of antenna elements.

In some embodiments, the slots may be integrated into or conformally mounted to a housing of the system, to minimize cost and size of the system, and to provide support for the antenna apparatus.

Advantageously, a controller of the system may select a particular configuration of antenna elements and a corresponding configurable radiation pattern that minimizes interference over the wireless link to the remote receiving node. If the wireless link experiences interference, for example due to other radio transmitting devices, or changes or disturbances in the wireless link between the system and the remote receiving node, the system may select a different combination of selected antenna elements to change the corresponding radiation pattern and minimize the interference. The system may select a configuration of selected antenna elements corresponding to a maximum gain between the system and the remote receiving node. Alternatively, the system may select a configuration of selected antenna elements corresponding to less than maximal gain, but corresponding to reduced interference in the wireless link.

FIG. 1 illustrates a system 100 comprising an antenna apparatus 110 with selectable horizontal and vertical polarization elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, a Voice Over Internet telephone, and a remote terminal such as a handheld gaming device.

In some exemplary embodiments, the system 100 comprises an access point for communicating to one or more remote receiving nodes (not shown) over a wireless link, for example in an 802.11 wireless network. Typically, the system 100 may receive data from a router connected to the Internet (not shown), and the system 100 may transmit the data to one or more of the remote receiving nodes. The system 100 may also form a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the antenna apparatus, the system 100 may also receive data from the remote receiving node via the antenna apparatus.

The system 100 includes a communication device 120 (e.g., a transceiver) and an antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, the communication device 120 comprises well-known circuitry for receiving data packets of video from the router and circuitry for converting the data packets into 802.11 compliant RF signals.

As described further herein, the antenna apparatus 110 comprises a plurality of antenna elements including a plurality of dipoles and/or a plurality of slots. The dipoles are configured to generate vertical polarization, and the slots are configured to generate horizontal polarization. Each of the antenna elements provides gain (with respect to isotropic).

In embodiments with individually selectable antenna elements, each antenna element may be electrically selected (e.g., switched on or off) so that the antenna apparatus 110 may form a configurable radiation pattern. The antenna apparatus 110 may include an antenna element selecting device configured to selectively couple one or more of the antenna elements to the communication device 120. By selectively coupling one or more of the antenna elements to the communication device 120, the system 100 may transmit/receive with horizontal polarization, vertical polarization, or diagonal polarization. Further, the system 100 may also transmit/receive with configurable radiation patterns ranging from highly directional to substantially omnidirectional, depending upon which of the antenna elements are coupled to the communication device 120.

Mechanisms for selecting one or more of the antenna elements are described further in particular in co-pending U.S. application Ser. No. 11/180,329 titled "System and Method for Transmission Parameter Control for an Antenna Apparatus with Selectable Elements" filed Jul. 12, 2005, and other applications listed herein and incorporated by reference.

Figure 2:
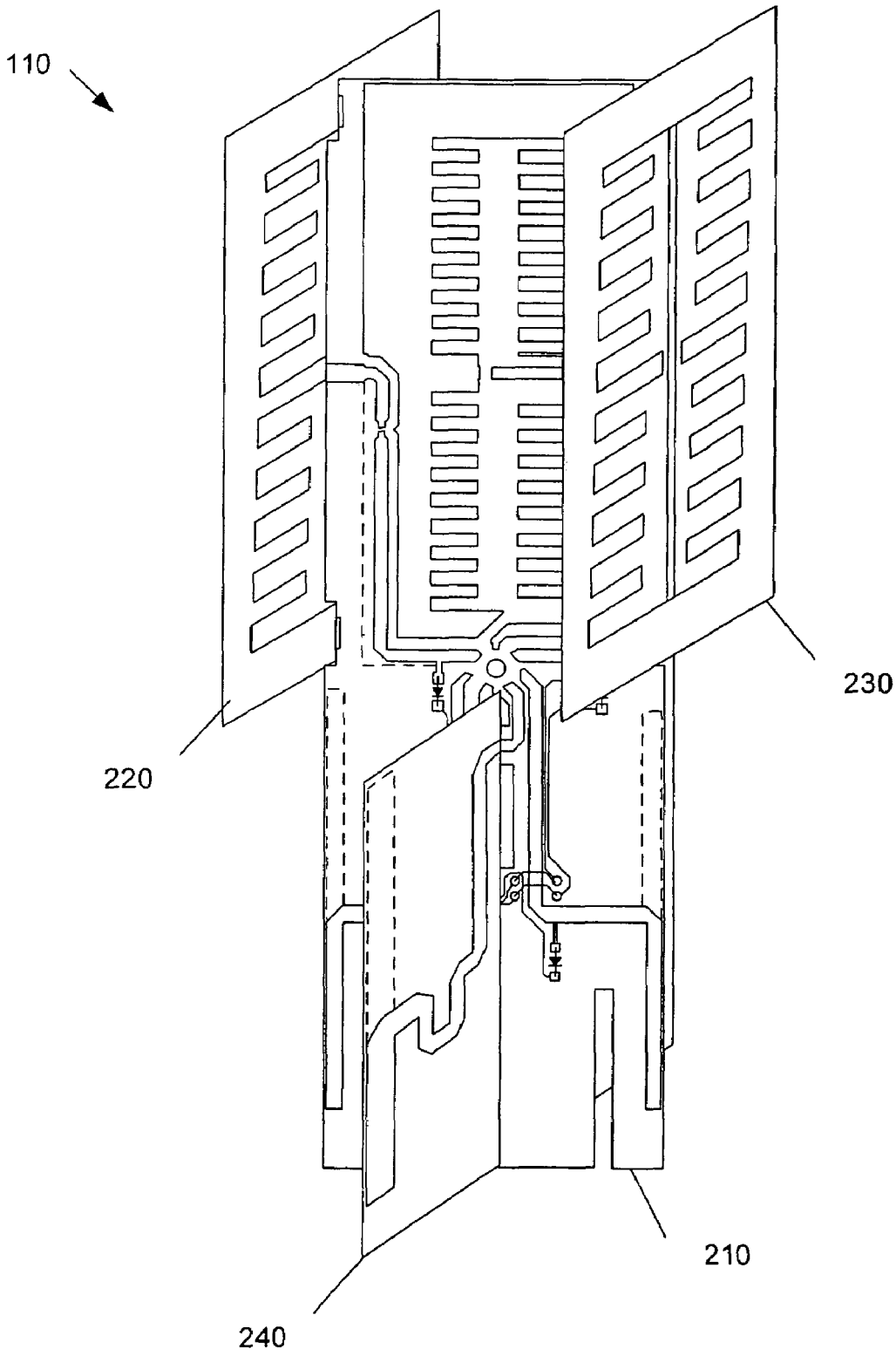
FIG. 2 illustrates the antenna apparatus of FIG. 1, in one embodiment in accordance with the present invention.

FIG. 2 illustrates the antenna apparatus 110 of FIG. 1, in one embodiment in accordance with the present invention. The antenna apparatus 110 of this embodiment includes a first substrate 210 (parallel to the plane of FIG. 2), a second substrate 220 (perpendicular to the plane of FIG. 2), a third substrate 230 (perpendicular to the plane of FIG. 2), and a fourth substrate 240 (perpendicular to the plane of FIG. 2).

As described further with respect to FIG. 3, the first substrate 210 includes a slot, two dipoles, and an antenna element selector (not labeled, for clarity). The second substrate 220 includes a slot antenna perpendicular to and coupled to a first edge of the first substrate 210. The third substrate 230 includes a slot perpendicular to and opposite from the second substrate 220 on the first substrate 210. The fourth substrate 240 includes two dipoles (one of the dipoles is obscured in FIG. 2 by the first substrate 210) and is perpendicular to and coupled to the first substrate 210.

As described further herein, the substrates 210-240 may be partitioned or sectioned from a single PCB. The substrates 210-240 have a first side (depicted as solid lines) and a second side (depicted as dashed lines) substantially parallel to the first side. The substrates 210-240 comprise a PCB such as FR4, Rogers 4003, or other dielectric material.

Figure 3A:
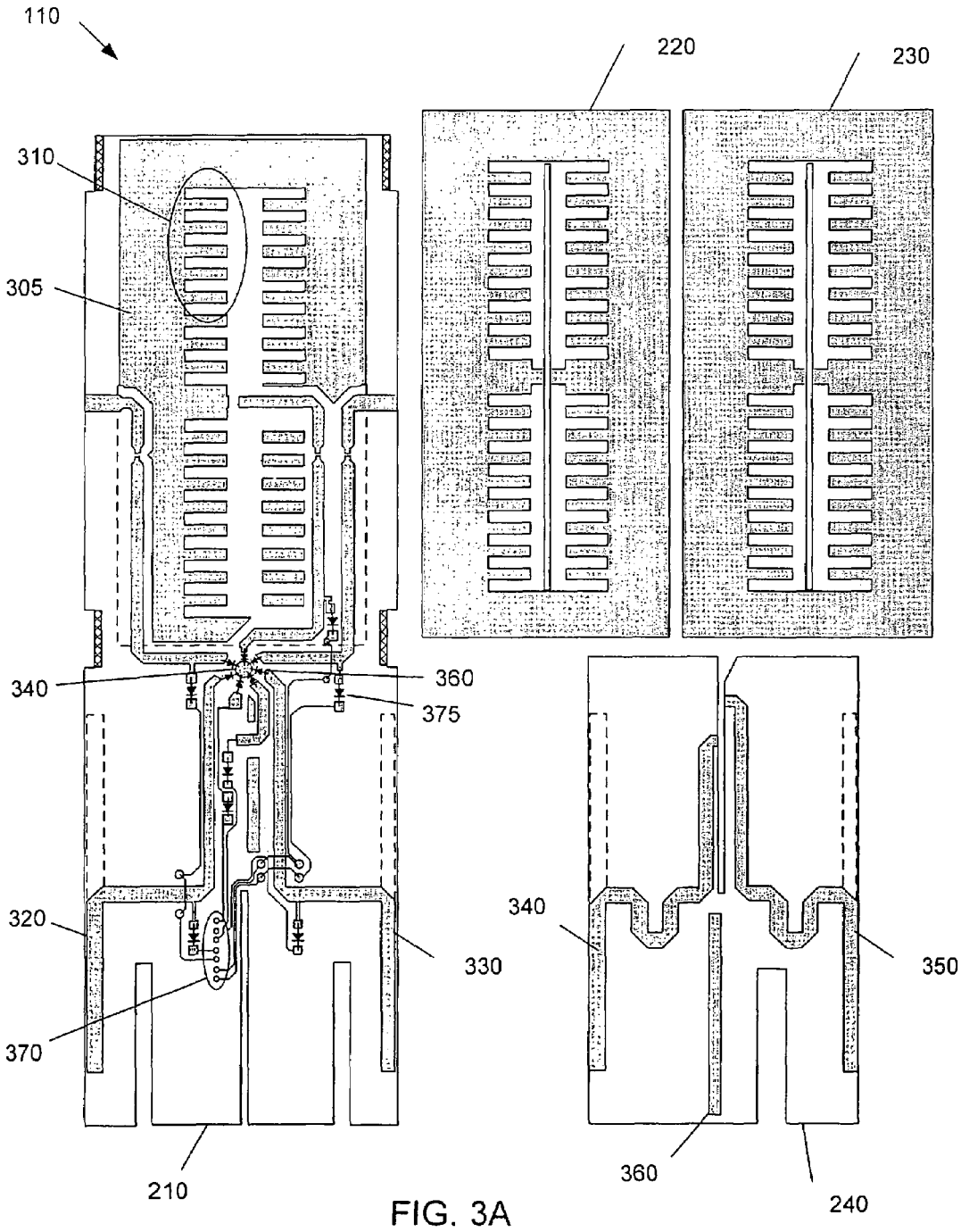
FIG. 3A illustrates PCB components (in solid lines and shading, not to scale) for forming the slots, dipoles, and antenna element selector on the first side of the substrates of FIG. 2, in one embodiment in accordance with the present invention.

FIG. 3A illustrates PCB components (in solid lines and shading, not to scale) for forming the slots, dipoles, and antenna element selector on the first side of the substrates 210-240 of FIG. 2, in one embodiment in accordance with the present invention. PCB components on the second side of the substrates 210-240 (described with respect to FIG. 3B) are shown as dashed lines. Dimensions in mils of the PCB components depicted in FIGS. 3A and 3B (collectively, FIG. 3) are depicted in FIG. 4.

The first side of the substrate 210 includes a portion 305 of a first slot antenna including "fingers" 310 (only a few of the fingers 310 are circled, for clarity), a portion 320 of a first dipole, a portion 330 of a second dipole, and the antenna element selector (not labeled for clarity). The antenna element selector includes a radio frequency feed port 340 for receiving and/or transmitting an RF signal to the communication device 110, and a coupling network (not labeled) for selecting one or more of the antenna elements.

The first side of the substrate 220 includes a portion of a second slot antenna including fingers. The first side of the substrate 230 also includes a portion of a third slot antenna including fingers.

As depicted, to minimize or reduce the size of the antenna apparatus 110, each of the slots includes fingers. The fingers are configured to slow down electrons, changing the resonance of each slot, thereby making each of the slots electrically shorter. At a given operating frequency, providing the fingers allows the overall dimension of the slot to be reduced, and reduces the overall size of the antenna apparatus 110.

The first side of the substrate 240 includes a portion 340 of a third dipole and portion 350 of a fourth dipole. One or more of the dipoles may optionally include passive elements, such as a director 360 (only one director shown for clarity). Directors comprises passive elements that constrain the directional radiation pattern of the modified dipoles, for example to increase the gain of the dipole. Directors are described in more detail in U.S. application Ser. No. 11/010,076 titled "System and Method for an Omnidirectional Planar Antenna Apparatus with Selectable Elements" filed Dec. 9, 2004 and other co-pending applications referenced herein and incorporated by reference.

The radio frequency feed port 340 and the coupling network of the antenna element selector are configured to selectively couple the communication device 110 of FIG. 1 to one or more of the antenna elements. It will be apparent to a person or ordinary skill that many configurations of the coupling network may be used to couple the radio frequency feed port 340 to one or more of the antenna elements.

In the embodiment of FIG. 3, the radio frequency feed port 340 is configured to receive an RF signal from and/or transmit an RF signal to the communication device 110, for example by an RF coaxial cable coupled to the radio frequency feed port 340. The coupling network is configured with DC blocking capacitors (not shown) and active RF switches 360 (shown schematically, not all RF switches labeled for clarity) to couple the radio frequency feed port 340 to one or more of the antenna elements.

The RF switches 360 are depicted as PIN diodes, but may comprise RF switches such as GaAs FETs or virtually any RF switching device. The PIN diodes comprise single-pole single-throw switches to switch each antenna element either on or off (i.e., couple or decouple each of the antenna elements to the radio frequency feed port 340). A series of control signals may be applied via a control bus 370 (circled in FIG. 3A) to bias each PIN diode. With the PIN diode forward biased and conducting a DC current, the PIN diode switch is on, and the corresponding antenna element is selected. With the diode reverse biased, the PIN diode switch is off.

In some embodiments, one or more light emitting diodes (LEDs) 375 (not all LED are labeled for clarity) are optionally included in the coupling network as a visual indicator of which of the antenna elements is on or off. A light emitting diode may be placed in circuit with the PIN diode so that the light emitting diode is lit when the corresponding antenna element is selected.

Figure 3B:
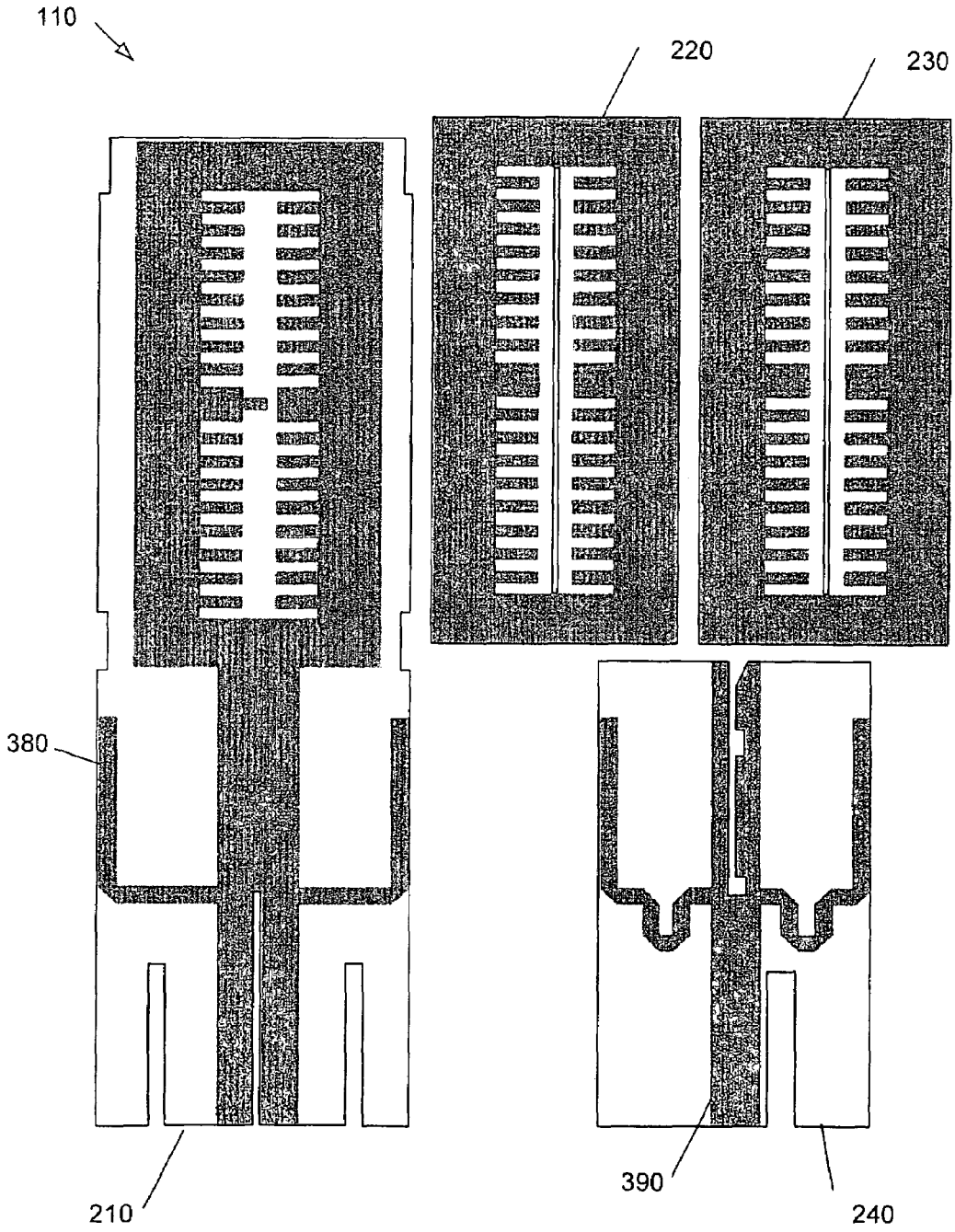
FIG. 3B illustrates PCB components (not to scale) for forming the slots, dipoles, and antenna element selector on the second side of the substrates of FIG. 2 for the antenna apparatus of FIG. 1, in one embodiment in accordance with the present invention.
Figure 4:
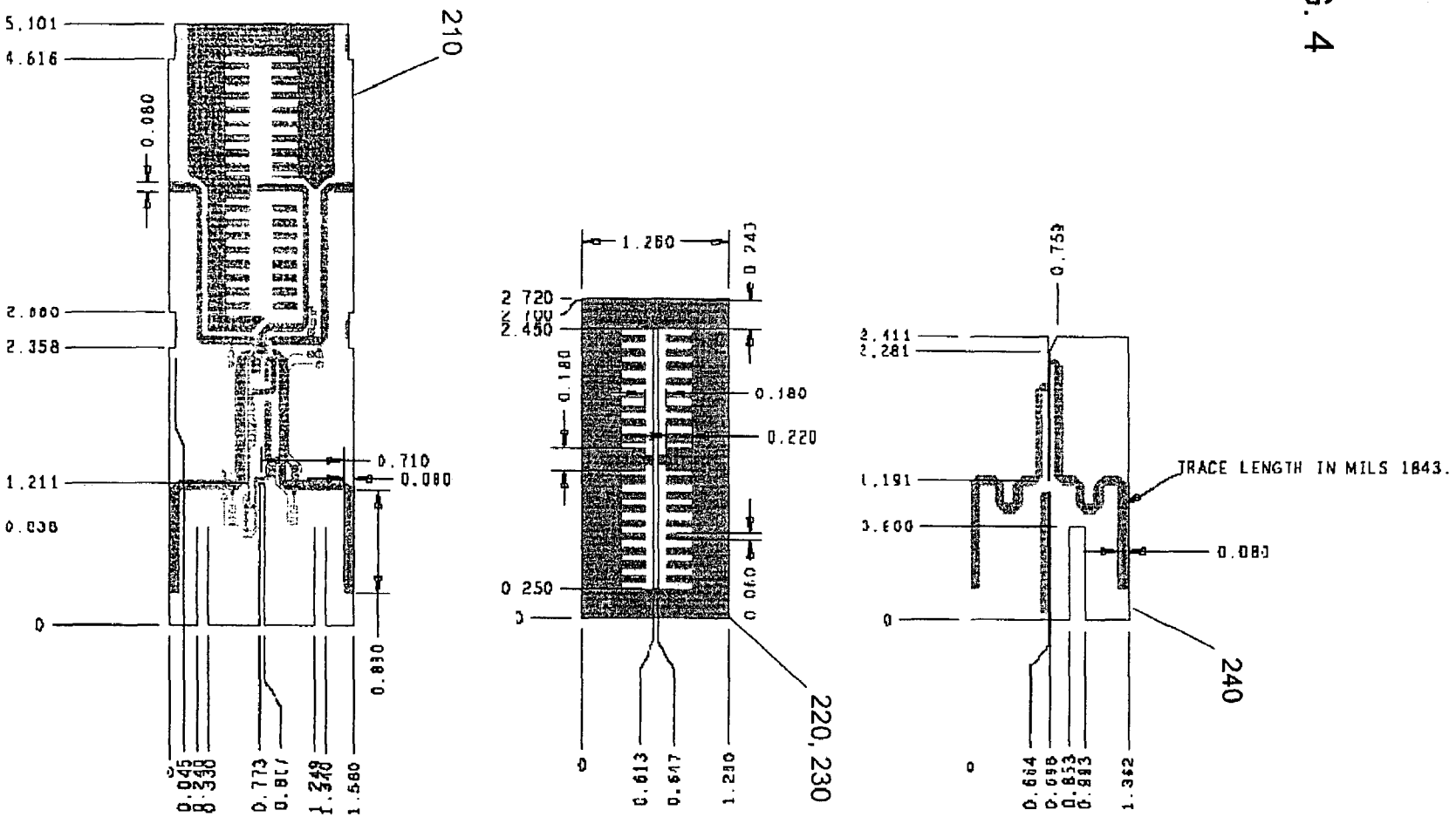
FIG. 4 illustrates various dimensions (in mils) for antenna elements of the antenna apparatus of FIG. 3, in one embodiment in accordance with the present invention.

FIG. 3B illustrates PCB components (not to scale) for forming the slots, dipoles, and antenna element selector on the second side of the substrates 210-240 of FIG. 2 for the antenna apparatus 110 of FIG. 1, in one embodiment in accordance with the present invention. PCB components on the first side of the substrates 210-240 (described with respect to FIG. 3A) are not shown for clarity.

On the second side of the substrates 210-240, the antenna apparatus 110 includes ground components configured to "complete" the dipoles and the slots on the first side of the substrates 210-240. For example, the portion of the dipole 320 on the first side of the substrate 210 (FIG. 3A) is completed by the portion 380 on the second side of the substrate 210 (FIG. 3B). The resultant dipole provides a vertically polarized directional radiation pattern substantially as the plane of the substrate 210.

Optionally, the second side of the substrates 210-240 may include passive elements for modifying the radiation pattern of the antenna elements. Such passive elements are described in detail in U.S. application Ser. No. 11/010,076 titled "System and Method for an Omnidirectional Planar Antenna Apparatus with Selectable Elements" filed Dec. 9, 2004 and other co-pending applications referenced herein and incorporated by reference. For example, the substrate 240 includes a reflector 390 as part of the ground component. The reflector 390 is configured to broaden the frequency response of the dipoles.

FIG. 4 illustrates various dimensions (in mils) for antenna elements of the antenna apparatus 110 of FIG. 3, in one embodiment in accordance with the present invention. It will be appreciated that the dimensions of individual components of the antenna apparatus 110 depend upon a desired operating frequency of the antenna apparatus 110. The dimensions of the individual components may be established by use of RF simulation software, such as IE3D from Zeland Software of Fremont, Calif. For example, the antenna apparatus 110 incorporating the components of dimension according to FIG. 4 is designed for operation near 2.4 GHz, based on a substrate PCB of FR4 material, but it will be appreciated by a person of ordinary skill that a different substrate having different dielectric properties, such as Rogers 4003, may require different dimensions than those shown in FIG. 4.

Figure 5:
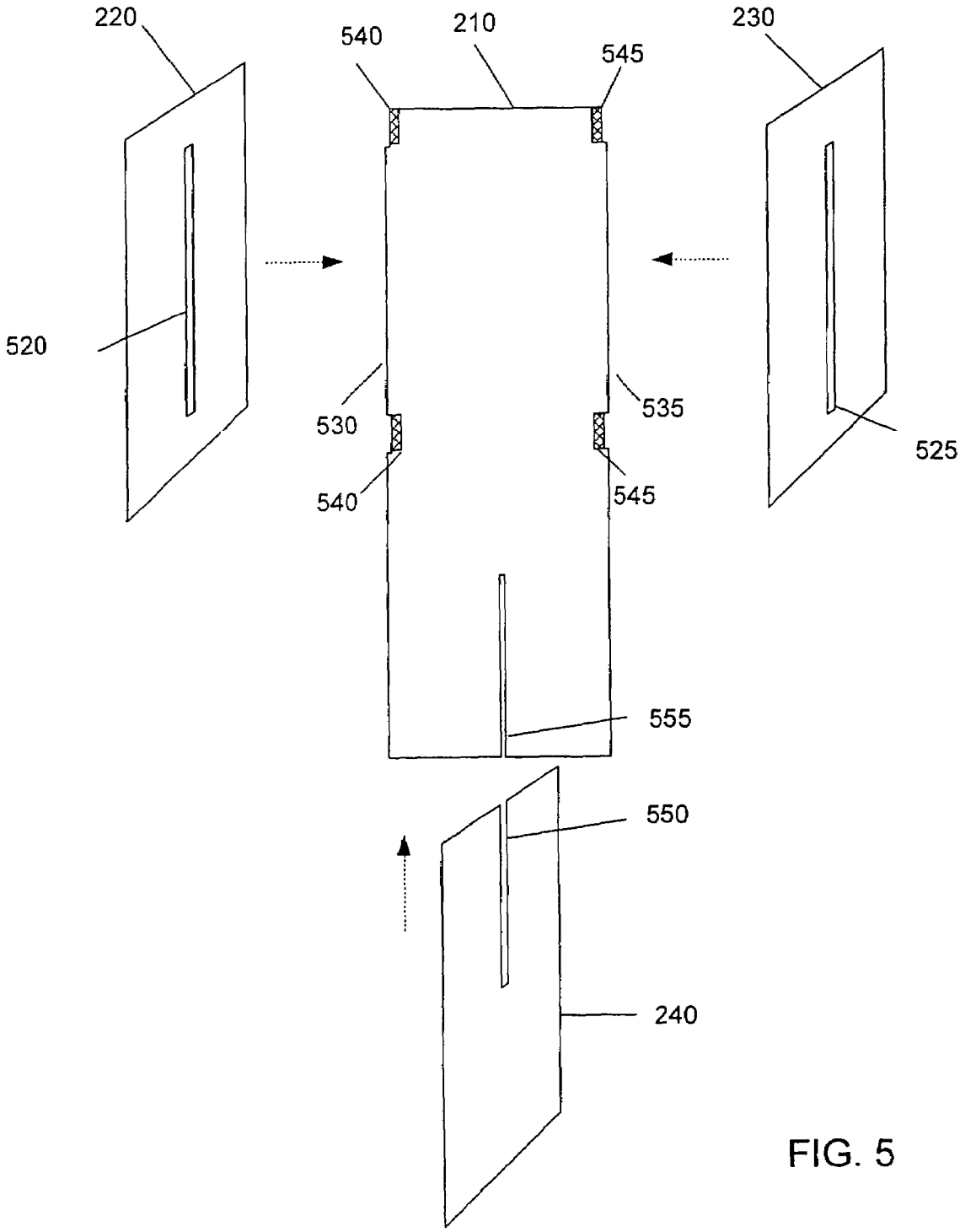
FIG. 5 illustrates an exploded view to show a method of manufacture of the antenna apparatus of FIG. 3, in one embodiment in accordance with the present invention.

FIG. 5 illustrates an exploded view to show a method of manufacture of the antenna apparatus 110 of FIG. 3, in one embodiment in accordance with the present invention. In this embodiment, the substrates 210-240 are first formed from a single PCB. The PCB may comprise a part of a large panel upon which many copies of the substrates 210-240 are formed. After being partitioned from the PCB, the substrates 210-240 are oriented and affixed to each other.

An aperture (slit) 520 of the substrate 220 is approximately the same width as the thickness of the substrate 210. The slit 520 is aligned to and slid over a tab 530 included on the substrate 210. The substrate 220 is affixed to the substrate 210 with electronic solder to the solder pads 540. The solder pads 540 are oriented on the substrate 210 to electrically and/or mechanically bond the slot antenna of the substrate 220 to the coupling network and/or the ground components of the substrate 210.

Alternatively, the substrate 220 may be affixed to the substrate 210 with conductive glue (e.g., epoxy) or a combination of glue and solder at the interface between the substrates 210 and 220. However, affixing the substrate 220 to the substrate 210 with electronic solder at the solder pads 540 has the advantage of reducing manufacturing steps, since the electronic solder can provide both a mechanical bond and an electrical coupling between the slot antenna of the substrate 220 and the coupling network of the substrate 210.

In similar fashion to that just described, to affix the substrate 230 to the substrate 210, an aperture (slit) 525 of the substrate 230 is aligned to and slid over a tab 535 included on the substrate 210. The substrate 230 is affixed to the substrate 210 with electronic solder to solder pads 545, conductive glue, or a combination of glue and solder.

To affix the substrate 240 to the substrate 210, a mechanical slit 550 of the substrate 240 is aligned with and slid over a corresponding slit 555 of the substrate 210. Solder pads (not shown) on the substrate 210 and the substrate 240 electrically and/or mechanically bond the dipoles of the substrate 240 to the coupling network and/or the ground components of the substrate 210.

Figure 6:
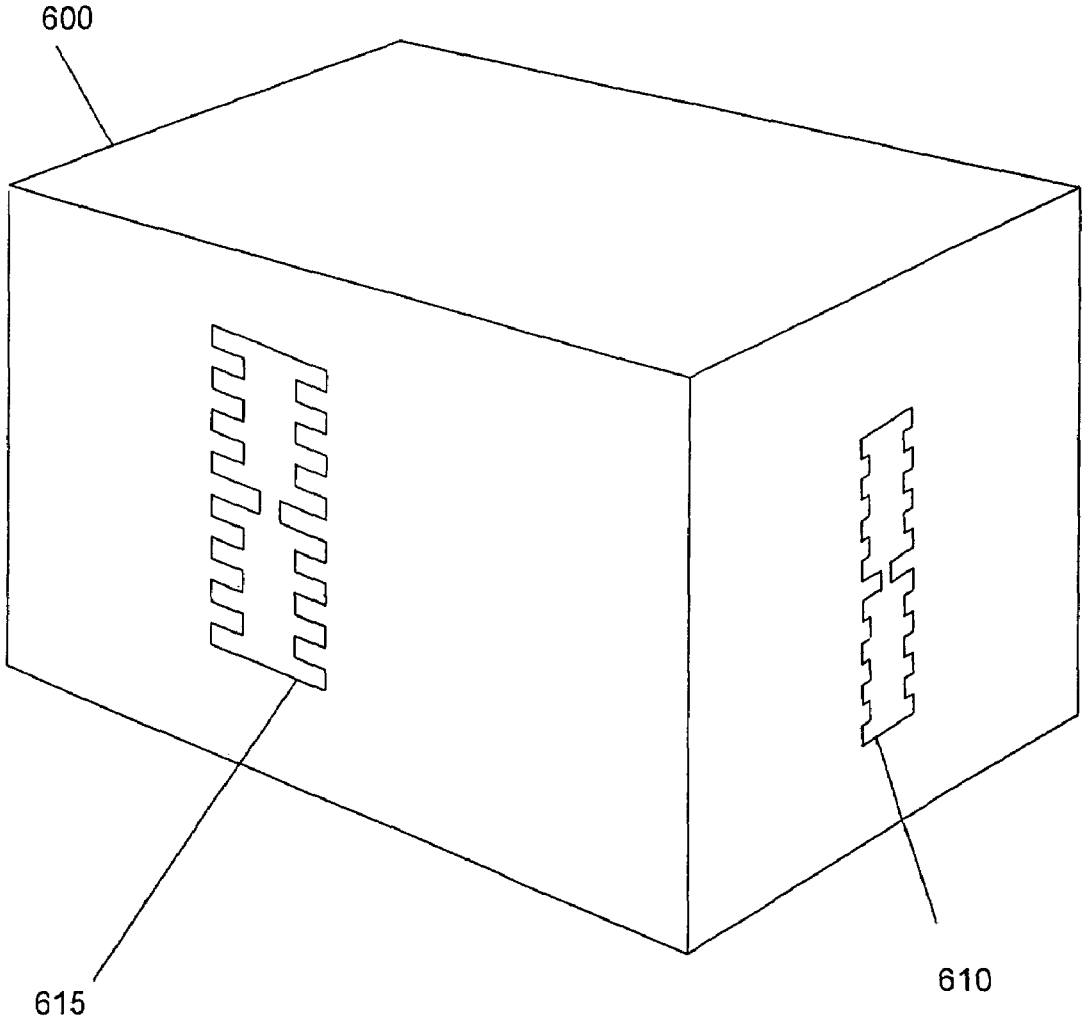
FIG. 6 illustrates an alternative embodiment for the slots of the antenna apparatus in a housing of the system of FIG. 1.

FIG. 6 illustrates an alternative embodiment for the slots of the antenna apparatus 110 in a housing 600 of the system 100 of FIG. 1. The housing 600 incorporates the antenna apparatus 110 by including a number of slot antennas 610 and 615 (only two slots depicted for clarity) on one or more faces of the housing 600. The dipoles depicted in FIG. 3 may be included internally to the housing 600 (e.g., for a plastic housing), provided externally to the housing 600 (e.g., for a metal or other RF-conductive housing), or not included in the antenna apparatus 110.

The slots 610 and 615 include fingers for reducing the overall size of the slots, as described herein. The slots 610 and 615 may be oriented in the same or different directions. In some embodiments, the housing 600 comprises a metallic or otherwise conductive housing 600 for the system 100, and one or more of the slots 610 and 615 are integral with, and formed from, the housing 600. For example, the housing 600 may be formed from metal such as stamped steel, aluminum, or other RF conducting material.

The slots 610 and 615 may be formed from, and therefore coplanar with, the housing 600. To prevent damage from foreign matter entering the openings in the housing 600 formed by the slots, the slots may be covered with non-conductive material such as plastic. In alternative embodiments, one or more of the slots 610 and 615 may be separately formed (e.g., of the PCB traces or conductive foil) and conformally-mounted to the housing 600 of the system 100, for example if the housing 600 is made of non-conductive material such as plastic.

Although FIG. 6 depicts two slots 610 and 615, one or more slots may be formed on one or more sides of the housing. For example, with a 6-sided housing (top, bottom, and four sides), four slots may be included in the housing, one slot on each of the vertical sides of the housing other than the top and bottom. The slots may be oriented in the same or different directions, depending on the desired radiation pattern.

For the embodiment of FIG. 6 in which the antenna apparatus 110 incorporates slots on the housing 600, the antenna element selector (FIG. 3) may comprise a separate structure (not shown) from the slots 610 and 615. The antenna element selector may be mounted on a relatively small PCB, and the PCB may be electrically coupled to the slots 610 and 615, for example by RF coaxial cables.

Other Embodiments

Although not depicted, the system 100 of FIG. 1 may include multiple parallel communication devices 120 coupled to the antenna apparatus 110, for example in a multiple input multiple output (MIMO) architecture such as that disclosed in co-pending U.S. application Ser. No. 11/190,288 titled "Wireless System Having Multiple Antennas and Multiple Radios" filed Jul. 26, 2005. For example, the horizontally polarized slots of the antenna apparatus 110 may be coupled to a first of the communication devices 120 to provide selectable directional radiation patterns with horizontal polarization, and the vertically polarized dipoles may be coupled to the second of the communication devices 120 to provide selectable directional radiation patterns with vertical polarization. The antenna feed port 340 and associated coupling network of FIG. 3A may be modified to couple the first and second communication devices 120 to the appropriate antenna elements of the antenna apparatus 110. In this fashion, the system 100 may be configured to provide a MIMO capable system with a combination of directional to omnidirectional coverage as well as horizontal and/or vertical polarization.

In other alternative embodiments, the antenna elements of the antenna apparatus 110 may be of varying dimension, for operation at different operating frequencies and/or bandwidths. For example, with two radio frequency feed ports 340 (FIG. 3) and two communications devices 120 (FIG. 1), the antenna apparatus 110 may provide operation at two center frequencies and/or operating bandwidths.

In some embodiments, to further minimize or reduce the size of the antenna apparatus 110, the dipoles may optionally incorporate one or more loading structures as are described in co-pending U.S. application Ser. No. 11/041,145 titled "System and Method for a Minimized Antenna Apparatus with Selectable Elements" filed Jan. 21, 2005. The loading structures are configured to slow down electrons, changing the resonance of the dipole, thereby making the dipole electrically shorter. At a given operating frequency, providing the loading structures allows the dimension of the dipole to be reduced.

In some embodiments, to further minimize or reduce the size of the antenna apparatus 110, the ½-wavelength slots depicted in FIG. 3, may be "truncated" in half to create ¼-wavelength modified slot antennas. The ¼-wavelength slots provide a different radiation pattern than the ½-wavelength slots.

A further variation is that the antenna apparatus 110 disclosed herein may incorporate the minimized antenna apparatus disclosed in U.S. application Ser. No. 11/041,145 wholly or in part. For example, the slot antennas described with respect to FIG. 3 may be replaced with the minimized antenna apparatus of U.S. application Ser. No. 11/041,145.

In alternate embodiments, although the antenna apparatus 110 is described as having four dipoles and three slots, more or fewer antenna elements are contemplated. Generally, as will be apparent to a person or ordinary skill upon review of the co-pending applications referenced herein, providing more antenna elements of a particular configuration (more dipoles, for example), yields a more configurable radiation pattern formed by the antenna apparatus 110.

An advantage of the foregoing is that in some embodiments the antenna elements of the antenna apparatus 110 may each be selectable and may be switched on or off to form various combined radiation patterns for the antenna apparatus 110. Further, the antenna apparatus 110 includes switching at RF as opposed to switching at baseband. Switching at RF means that the communication device 120 requires only one RF up/down converter. Switching at RF also requires a significantly simplified interface between the communication device 120 and the antenna apparatus 110. For example, the antenna apparatus 110 provides an impedance match under all configurations of selected antenna elements, regardless of which antenna elements are selected.

Another advantage is that the antenna apparatus 110 comprises a 3-dimensional manufactured structure of relatively low complexity that may be formed from inexpensive and readily available PCB material.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A system, comprising:

a communication device configured to generate or receive a radio frequency (RF) signal;

an antenna apparatus configured to radiate or receive the RF signal, the antenna apparatus including a first planar element configured to radiate or receive the RF signal in a horizontal polarization and a second planar element configured to radiate or receive the RF signal in a vertical polarization; and an antenna element selector configured to couple the RF signal to the first planar element or the second planar element, wherein the antenna element selector comprises a PIN diode network configured to couple the RF signal to the first planar element or the second planar element.

2. The system of claim 1, wherein the antenna apparatus is further configured to radiate or receive the RF signal in a diagonal polarization if the first planar element and the second planar element are coupled to the RF signal.

3. The system of claim 1, wherein the antenna apparatus is further configured to radiate or receive the RF signal in a substantially omnidirectional radiation pattern.

4. The system of claim 1, wherein the antenna apparatus is further configured to concentrate the radiation pattern of the first planar element.

5. The system of claim 1, wherein the first planar element comprises one or more loading elements configured to decrease a footprint of the first planar element.

6. The system of claim 1, wherein the first planar element comprises a slot antenna.

7. The system of claim 1, wherein the first planar element comprises a slot antenna and the second planar element comprises a dipole.

8. The system of claim 1, wherein the second planar element comprises a dipole further comprising one or more loading structures configured to decrease a footprint of the dipole and produce a directional radiation pattern with polarization substantially in the plane of the second planar element.

9. The system of claim 1 wherein the second planar antenna element comprises a dipole including a reflector, the reflector configured to broaden the frequency response of the dipole.

10. An antenna apparatus, comprising:

a first substrate including a first planar element configured to radiate or receive a radio frequency (RF) signal in a horizontal polarization;

a second planar element on the first substrate, the second planar element configured to radiate or receive the RF signal in a vertical polarization; and an antenna element selector configured to communicate the RF signal with a communication device the antenna element selector further configured to couple the RF signal to first planar element or the second planar element.

11. The antenna apparatus of claim 10, wherein the first planar element is coupled to the second planar element.

12. The antenna apparatus of claim 10, wherein the first planar element and the second planar element comprise a circuit board.

13. The antenna apparatus of claim 10, wherein the first substrate comprises a circuit board, further comprising a second substrate including a third planar element coupled substantially perpendicularly to the circuit board.

14. The antenna apparatus of claim 13, wherein the second substrate is coupled to the circuit board by solder.

15. A method of manufacturing an antenna apparatus, comprising:

forming a first antenna element and a second antenna element from a printed circuit board substrate;

positioning the printed circuit board substrate into a first portion including the first antenna element and a second portion including the second antenna element; and coupling the first portion to the second portion to form a non-planar antenna apparatus, wherein coupling the first portion to the second portion comprises soldering the first portion to the second portion.

16. A system, comprising:

a housing;

a communication device; and an antenna apparatus integral with the housing, the antenna apparatus including one or more slot antennas, wherein one or more of the slot antennas comprises loading elements configured to decrease a footprint of the slot antenna.

17. The system of claim 16, wherein one or more of the slot antennas comprises an aperture formed in the housing.

* * * * *

US007358912C1

(12) INTER PARTES REEXAMINATION CERTIFICATE (488th)

United States Patent

Kish et al.

(10) Number: US 7,358,912 C1

(45) Certificate Issued: Nov. 15, 2012

(54) COVERAGE ANTENNA APPARATUS WITH SELECTABLE HORIZONTAL AND VERTICAL POLARIZATION ELEMENTS

(75) Inventors: William Kish, Saratoga, CA (US); Victor Shtrom, Sunnyvale, CA (US)

(73) Assignee: Ruckus Wireless, Inc., Mountain View, CA (US)

Reexamination Request:
No. 95/001,079, Sep. 4, 2008

Reexamination Certificate for:

| | |
|---|---|
| Patent No.: | **7,358,912** |
| Issued: | **Apr. 15, 2008** |
| Appl. No.: | **11/413,461** |
| Filed: | **Apr. 28, 2006** |

Related U.S. Application Data

(60) Provisional application No. 60/694,101, filed on Jun. 24, 2005.

(51) Int. Cl.
*H01Q 21/00* (2006.01)

(52) U.S. Cl. ..... 343/725; 343/727

(58) Field of Classification Search ..... None
See application file for complete search history.

(56) References Cited

To view the complete listing of prior art documents cited during the proceeding for Reexamination Control Number 95/001,079, please refer to the USPTO's public Patent Application Information Retrieval (PAIR) system under the Display References tab.

*Primary Examiner* — Christopher E. Lee

(57) ABSTRACT

An antenna apparatus comprises selectable antenna elements including a plurality of dipoles and/or a plurality of slot antennas ("slot"). Each dipole and/or each slot provides gain with respect to isotropic. The dipoles may generate vertically polarized radiation and the slots may generate horizontally polarized radiation. Each antenna element may have one or more loading structures configured to decrease the footprint (i.e., the physical dimension) of the antenna element and minimize the size of the antenna apparatus.

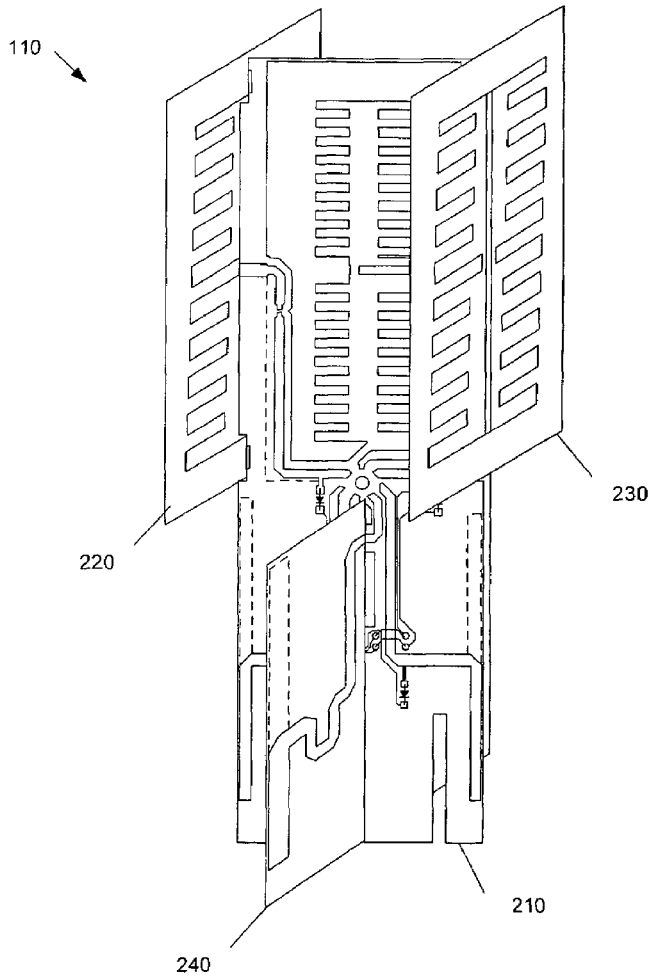

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-17 are cancelled.

* * * * *